US010662589B2

(12) United States Patent
Wright

(10) Patent No.: US 10,662,589 B2
(45) Date of Patent: May 26, 2020

(54) INDUSTRIAL SUPPORT MAT INTERLOCK DEVICE

(71) Applicant: Matrax, Inc., Lutherville, MD (US)

(72) Inventor: Joseph M. Wright, Green Pond, NJ (US)

(73) Assignee: Matrax, Inc., Lutherville, MD (US)

( * ) Notice: Subject to any disclaimer, the term of this patent is extended or adjusted under 35 U.S.C. 154(b) by 0 days.

(21) Appl. No.: 15/936,258

(22) Filed: Mar. 26, 2018

(65) Prior Publication Data

US 2018/0274183 A1 Sep. 27, 2018

Related U.S. Application Data

(60) Provisional application No. 62/476,043, filed on Mar. 24, 2017.

(51) Int. Cl.

| | |
|---|---|
| ***E01C 9/08*** | (2006.01) |
| ***E01C 5/16*** | (2006.01) |
| ***E01C 5/20*** | (2006.01) |
| ***E01C 11/02*** | (2006.01) |
| ***E01C 5/22*** | (2006.01) |

(52) U.S. Cl.

CPC ..... *E01C 9/08* (2013.01); *E01C 5/16* (2013.01); *E01C 5/20* (2013.01); *E01C 5/22* (2013.01); *E01C 9/083* (2013.01); *E01C 9/086* (2013.01); *E01C 11/02* (2013.01); *E01C 2201/12* (2013.01)

(58) Field of Classification Search

CPC ..... E01C 5/16; E01C 5/20; E01C 5/22; E01C 11/02; E01C 2201/12; E01C 9/08; E01C 9/083; E01C 9/086

See application file for complete search history.

(56) References Cited

U.S. PATENT DOCUMENTS

| | | | | |
|---|---|---|---|---|
| 2,819,026 | A | 1/1958 | Leyendecker | |
| 3,859,000 | A * | 1/1975 | Webster | B63B 35/34 404/41 |
| 4,462,712 | A | 7/1984 | Penland, Sr. | |
| 4,629,358 | A | 12/1986 | Springston et al. | |
| 5,097,643 | A * | 3/1992 | Wittler | E04B 2/7425 160/135 |
| 5,313,751 | A * | 5/1994 | Wittler | E04B 2/7425 160/135 |
| 5,630,304 | A | 5/1997 | Austin | |
| 5,653,551 | A | 8/1997 | Seaux | |
| 5,888,612 | A | 3/1999 | Needham et al. | |
| 6,695,527 | B2 * | 2/2004 | Seaux | E01C 9/086 404/34 |
| 7,160,055 | B2 | 1/2007 | Beamish | |
| 7,303,800 | B2 * | 12/2007 | Rogers | B32B 3/02 428/44 |
| 7,604,431 | B2 | 10/2009 | Fournier | |

(Continued)

*Primary Examiner* — Abigail A Risic

(74) *Attorney, Agent, or Firm* — Baldini Law, LLC

(57) ABSTRACT

An interlocking joint device and method of using same, configured to adapt to and integrate with most existing industrial access matting products to create within those matting products an overlapping lip configuration that: (1) interlocks the pre-existing individual mats together; (2) protects the perimeter of the mat from excessive wear and damage to improve performance and versatility; and (3) provides a serviceable and/or replaceable part that creates an inexpensive alternative to replacing entire matting products.

10 Claims, 6 Drawing Sheets

(56) References Cited

U.S. PATENT DOCUMENTS

| | | | | |
|---|---|---|---|---|
| 8,061,929 | B2 * | 11/2011 | Dagesse | E01C 9/086 404/34 |
| 8,382,393 | B1 | 2/2013 | Phillips | |
| 8,414,217 | B2 | 4/2013 | Rosan | |
| 8,646,242 | B2 | 2/2014 | Shapiro et al. | |
| 9,506,255 | B1 * | 11/2016 | Jones | E01C 9/086 |
| 2005/0271852 | A1 * | 12/2005 | Solomon | E04B 1/6141 428/58 |
| 2007/0223993 | A1 * | 9/2007 | Peterson, Jr. | E01C 5/005 403/364 |
| 2009/0016817 | A1 * | 1/2009 | Kulhawe | E01C 5/00 404/17 |
| 2009/0301004 | A1 * | 12/2009 | Dagesse | E01C 9/086 52/177 |
| 2014/0137505 | A1 * | 5/2014 | Jean | E04B 5/023 52/588.1 |
| 2016/0017547 | A1 * | 1/2016 | Bordelon | B29D 99/0057 404/47 |
| 2016/0301161 | A1 * | 10/2016 | McDowell | H02B 13/025 |
| 2016/0340911 | A1 * | 11/2016 | Jean | F16B 37/044 |
| 2018/0029305 | A1 * | 2/2018 | Hugghins | B05D 1/265 |
| 2018/0030667 | A1 * | 2/2018 | Penland, Jr. | E01C 5/18 |

* cited by examiner

INDUSTRIAL SUPPORT MAT INTERLOCK DEVICE

FIELD OF THE INVENTION

The present disclosure is directed to an interlocking joint device and method of using same, configured to adapt to most existing industrial access matting products to create an overlapping lip configuration that: (1) interlocks individual mats together; (2) protects the perimeter of the mat from excessive wear and damage to improve performance and versatility; and (3) provides a serviceable and/or replaceable part that creates an inexpensive alternative to replacing entire matting products.

The present application claims the benefit of prior filed U.S. Provisional Application Ser. No. 62/476,043, filed by the present inventor on Mar. 24, 2017, which is incorporated herein by reference.

BACKGROUND

Industrial matting products are well known. There has long been a need for temporary roadways, equipment supports, and the like, in areas where the ground is swampy, muddy, sandy and soft and incapable of supporting industrial machinery needed at the site to perform as they are intended. Temporary stages or other structures also need a stable support base on which to be erected and industrial matting products have been developed to fit the bill.

In fact, as far back as the 1950's, a portable road construction which is sturdy and compact, and which can be laid with a minimum of effort was described by John Battice Leyendecker in U.S. Pat. No. 2,819,026 to be used to provide access to oil and gas well drilling sites.

In another example, U.S. Pat. No. 4,462,712 titled METHOD AND APPARATUS FOR A CONSTRUCTION SITE FLOORING SYSTEM, discloses, "a method and apparatus for the construction of a flooring system for use at a construction site such as an oil well drilling site. The flooring system is formed by interlocking a plurality of flooring units. Each of the flooring units includes a rectangular base section and a surface section attached to and overlaying the base section. One end of the rectangular base section is aligned with one end of the surface section which has at least one open-ended locking slot along its length."

In another example, U.S. Pat. No. 4,629,358 titled PREFABRICATED PANELS FOR RAPID RUNWAY REPAIR AND EXPEDIENT AIRFIELD SURFACING, discloses, "low profile portable panels consisting of fiberglass-reinforced plastic composite mats which include hollow inorganic silica spheres in the plastic resin to reduce weight have recessed molded lips and bushings along all edges for connecting panels together with bolts to form expedient airfield surfacing and repair having high flexural strength and high structural capacity."

In another example, U.S. Pat. No. 5,630,304 titled ADJUSTABLE INTERLOCK FLOOR TILE, discloses, "a quadrilateral floor tile . . . with a generally flat top surface with each side having a downward sloping edge, inclining toward the floor. Two of the sides, being adjacent, are formed with an integral interlocking strips, each having a plurality of spaced-apart male connecting members. The remaining sides of the tile are formed with a plurality of cavities located to the interior to the sloping edge. Each of the cavities is positioned to mate with a corresponding male connecting member of a neighboring tile."

In another example, U.S. Pat. No. 5,653,551 titled, MAT SYSTEM FOR CONSTRUCTION OF ROADWAYS AND SUPPORT SURFACES, discloses, "a reusable mat system for constructing roadways and equipment support surfaces comprising a plurality of uniform individual mats which are constructed of lightweight composite materials and which include strengthening agents. The individual mats partially overlap and interlock to form a continuous and substantially smooth surface, to prevent undesired movement of the mats on location, and to permit quick installation of the mats by simple placement methods."

In another example, U.S. Pat. No. 5,888,612 titled, LOAD-BEARING STRUCTURES, discloses, "a load-bearing structure with a novel interlocking edge. Also provided is a method of making a load-bearing structure having an overlapping edge, in which structural members are combined so that a stepped-down lip of one structural member covers a peripheral edge of another member. Also provided is a load-bearing structure having cellular structure and which is useful with or without an overlapping edge."

In another example, U.S. Pat. No. 6,695,527 titled, INTERLOCKING MAT SYSTEM FOR CONSTRUCTION OF LOAD SUPPORTING SURFACES, discloses, "a reusable mat system for the construction of load bearing surfaces, such as temporary roadways and equipment support surfaces, over unstable or unsubstantial terrain, comprising durable, interlocking individual mats which can be quickly and easily installed in a single application, and which can thereafter be easily removed and stored until needed again. The individual mats of the present invention interlock on all sides to form stable and continuous load bearing surfaces, and exhibit favorable traction characteristics."

In another example, U.S. Pat. No. 7,160,055 titled ROAD MAT, discloses, "a road mat having a mat body with a first coupling end and a second coupling end. A first locking mechanism is provided at the first coupling end that includes a male coupling member and a female coupling member. A second locking mechanism is provided at the second coupling end that includes a male coupling member and a female coupling member. In one preferred embodiment of the present invention the first locking mechanism is a reciprocating mirror image of the second locking mechanism."

In another example, U.S. Pat. No. 7,303,800 titled, INTERLOCKING MAT, discloses, "a mat system with each mat having sloping lips which overlap with an adjacent mat's sloping lips and are secured by interlocking joints in the mats' lips and/or by captive locking pins to form an easily assembled and interconnected flat surface. In use, opposing ledges forms a slot within holes in the top overlapping lips to receive a captive locking pin. The pin is captive by mid body prongs which fix underneath the ledges in a mat's upper lip's holes, and the pin locks and unlocks with rotary turning of the pin resulting in the pin's keeper feet fixing underneath the similar ledges in the holes of the lower lip of an adjacent mat."

In another example, U.S. Pat. No. 7,604,431 titled INTERLOCKING GROUND COVER MATS, discloses, "ground cover mats comprised of boards contained within a metal frame. The side surfaces of the mats are connected using an interlock member and an interlock opening. The end surface for the mats is connected using a retaining pin that feeds through openings in perpendicular plates, or alternatively using complimentary pins and recesses.

In another example, U.S. Pat. No. 8,382,393 titled TEMPORARY ROADWAY FOR MOVING HEAVY EQUIPMENT ON AN INCLINE AND STEEP GRADES INCLUDING SYNTHETIC INTER-CONNECTING MOVABLE AND REMOVABLE STRUCTURAL MATS, discloses, "a temporary roadway with a static resistant synthetic inter-connectable structural mats which connect without tools or fasteners having a top layer, a middle layer and a bottom layer. The static resistant synthetic inter-connectable structural mats can have static charge conduction conduit through the mat and the mats can be made from 100 percent recycled rust proof, non-absorbing materials."

In another example, U.S. Pat. No. 8,414,217 titled HEAVY DUTY MODULAR FLOORING AND ROADWAY DEVICE, discloses, "a modular flooring system which is designed to support heavy loads while providing structural stability and ground protection. The invention contemplates a modular mat having an integral main body with offset mounting and assembly flanges and a lattice interior. The mat is constructed from a unitary piece of high strength plastic. Each flange edge contains an outward radiused edge, while each non-flange edge contains an inward radiused edge. Each flange engages with a corresponding flange on an adjacent tile, allowing the outward radiused and inward radiused edges to properly mate. One or more metal cam locks located along the upper flange edges are secured into corresponding cam receptacles located along the lower flange edge. The mats may utilize optional top covers to prevent water and debris from entering the mats. The modular flooring system provides increased strength and stability and protection of the subsurface in heavy industrial applications."

Finally, in another example, U.S. Pat. No. 8,646,242 titled MODULAR FLOOR TILE WITH CONNECTOR SYSTEM, discloses, "a modular floor tile may include a top surface, a plurality of edge surfaces, and a plurality of interlocking member for attachment to adjacent tiles. One interlocking member may include a protrusion having a curved interlocking portion. Another interlocking member may include a recess having a curved pocket portion. An interface between the curved interlocking portion of one tile and the curved pocket portion of another tile may allow pivot movement between the tiles. A modular floor may include a plurality of interlocking tiles connected to one another. Methods of forming a modular floor that includes a plurality of modular floor tiles are also disclosed."

Thus, there have been many attempts to provide better solutions for temporary roadway mats and support surfaces. Some have shown some type of end or edge interlock mechanism. None have a replaceable end or edge interlock mechanism. Each methodology is specific to the one matting product with which it is applied. In all examples, if the matting product or the interlocking mechanism is damaged, the entire piece, and in some cases, entire sections, need to be replaced and rebuilt. This is both cumbersome and expensive.

None of the foregoing references, alone or in combination, teach the salient and proprietary features of the present disclosure. None suggest a replaceable interlocking mechanism. None demonstrate a simple slide-in/out securing arrangement. In some arrangements, there is a snapping together and if anything breaks, the entire unit, and in some cases, the adjacent unit, need to be discarded. In some arrangements, there is a complex bolting of units together. In some cases, there is a complex interlocking mechanism requiring a delicate fitting together that breaks easily. In some cases, there is described an interlock, but when reviewing the optimal embodiments, there is only taught an overlay, not an actual interlock. In those cases, there is a transfer of load, but there is no means of stopping lateral or vertical separation between mats. Moreover, in these simple overlay cases, individual planks are used to transfer loads. In this concept, the construction teaches continuous transfer of load along the entire edge of each mat as a result of the contiguous attachment of entire edges of mats to each other. In some cases, in order to provide proper attachment, planks are secured through the use of nails and/or glue. This is a semi-permanent installation technique wherein the mats cannot be uninstalled without intensive labor and/or destroying the mats such that they cannot be re-used.

The present disclosure teaches several embodiments of an interlock mechanism that can be adapted to any existing or future industrial matting, temporary roadway or support surface product to create an easy to use, replaceable interlocking device and method by which said products can be interconnected in a secure manner to remain connected for as long as required, and also easily disconnected when desired. In one embodiment, if the device should become damaged, it is easily replaceable without discarding the undamaged matting product.

SUMMARY

The present disclosure teaches embodiments of an interlocking device and method of using it that adapts to pre-existing industrial matting, temporary roadway and support surface products such that said device can be inserted into a configured edge of said support surface product, thereby protecting said edge of said product and providing a mating surface that will mate with a corresponding configured edge of an adjacent said support surface product. Pre-existing industrial matting, temporary roadway and support surface products would first need a minor retrofit to create the edge recess configured to allow the device taught by this embodiment to slide into said recess and be used as the interlocking device described. Once the recess is created as described and shown herein, the device of this embodiment can easily slide into and/or out of the pre-existing support surface product at will, but will remain secure in place for so long as it is left in place. The new edge created is configured to mate with a corresponding alternate edge piece installed in a similar manner in a corresponding alternate pre-existing support surface product and held together with a simple pin, or any of many pre-existing methods depending on the installation required. Future support surface products may be manufactured at the outset to provide the configured recess to accept the device as described in this embodiment.

The present disclosure provides a device comprising:

i. a first insertable tongue section of a pre-determined width, length and thickness further comprising a plurality of raised securing ridges along a top and bottom surface;

ii. a second protruding mating section, configured as a top or bottom mating section, of a pre-determined width, length, thickness and cross-sectional geometric shape, wherein said cross-sectional geometric shape is configured to be a corresponding mating piece, top to bottom and bottom to top, connected to said first insertable tongue section and further comprising cut-outs along its length placed to correspond with cut-outs along the length of said corresponding mating pieces.

In one embodiment, the thickness of the insertable tongue is approximately one-third the thickness of a pre-existing industrial matting, temporary roadway, support surface product.

In one embodiment, there are approximately seven protruding raised securing ridges along both the top and bottom surface of the insertable tongue. In one embodiment, the protruding raised securing ridges are rounded to facilitate a smooth insertion into a configured recess in the industrial matting, temporary roadway and support surface products. In an alternate embodiment, the protruding raised securing ridges are squared off to facilitate a greater securing strength when inserted into a configured recess in the industrial matting, temporary roadway and support surface products. In yet another embodiment, the protruding raised securing ridges have a geometric interlocking puzzle shape such as an L-shape, hook or other more complex securing feature to further enhance the securing strength when inserted into a configured recess in the industrial matting, temporary roadway and support surface products. One of skill in the art will appreciate the desired combination of ease of insertion and securing strength based on the materials utilized and specific application to easily choose a desired configuration.

In one embodiment, the overall width of one complete male/top or female/bottom component is approximately twelve inches configured to provide approximately eight inches of overlap with its corresponding component, i.e., to the second protruding mating section with approximately four inches devoted to the first insertable tongue section. In this embodiment there is a portion common to both sections where the joinder occurs and these dimensions are only approximate. However, one of skill in the art will easily appreciate the needed dimensions based on the strength of the materials used and the matting products used. In one embodiment, the approximate lengths of these components will be either seven foot or fourteen foot, depending upon with which side of the matting product it is to be used. In a preferred embodiment, there is there is a section of the second protruding mating section that could be considered as common to also the first insertable tongue section, connecting the second protruding mating section to the first insertable tongue section, but also extending a tab the full width of the industrial matting, temporary roadway, support surface product such that it meets both surfaces of same. On one side, the tab then extends out and blends into the full width of the second protruding mating section. On the other side, the tab extends out a short distance before ending creating a largely rectangular tab portion and the second protruding mating section further comprising two angled cuts that mate snugly with its corresponding inverted male to female second protruding mating section, all as shown substantially in the FIGURES. In this embodiment, when a male and female second protruding mating section are fitted together, there is formed a substantially planar two-piece connected surface between each adjacent side of the matting products. Securing pins placed in the aligned cut out portions secure this formation and create a substantially planar surface in continuity.

In one embodiment, each protruding raised securing ridge along the top and bottom surface of the insertable tongue and the tongue itself is configured to slide into corresponding recesses carved or drilled out of the edge of a pre-existing industrial matting, temporary roadway, support surface product.

In one embodiment, the second protruding mating section connected to the insertable tongue is configured to be a top or bottom component. Each said mating section component is configured in such a way that a top section fits together snugly like a puzzle piece with a corresponding bottom section.

In one embodiment, each second protruding mating section, whether a top or bottom section, is configured such that the area directly connected to said insertable tongue is the full thickness of the pre-existing industrial matting, temporary roadway, support surface product with which it is to be used in order to provide protection for the edges of the support surface product.

In one embodiment, each top section is configured to mate and fit snugly against each corresponding bottom piece to combine to form a full spacer section comprising the entire area and full thickness of each adjacent pair of pre-existing industrial matting, temporary roadway, support surface product with which it is to be used.

In one embodiment, when mated together as described, said cut-outs in each corresponding top and bottom second protruding mating section align in order to accept a pin or other connecting device to keep the top and bottom sections mated without slipping apart.

In one embodiment, the length of each connected first insertable tongue section and each connected second protruding top or bottom mating section is identical and corresponds to the edge length of the pre-existing industrial matting, temporary roadway, support surface product with which it is to be used. Thus, in one embodiment, there will be two different lengths of the device of this disclosure required, for each top and bottom configuration, based on it being used with a length or width section of the support surface product.

In one embodiment, each side of a pre-existing industrial matting, temporary roadway, support surface product will be configured to accept a configured device as described herein, one top and one bottom configuration of each length as described, in an alternating fashion.

In one embodiment, one end of each configured device as described herein is straight and a ninety degree angle to the length of such device, while the other second end is configured on a diagonal at a forty-five degree angle to the length of such device. In an alternate embodiment, each end is a ninety degree angle (compare FIGS. 2 and 6).

In one embodiment, the device of the present disclosure as described herein may be manufactured from any known suitable material chosen for durability, pliability and strength and depending upon the specific application. It may or may not mimic the construction material and layering of the pre-existing industrial matting, temporary roadway, support surface product with which it is to be used.

DETAILED DESCRIPTION

Figure 1:
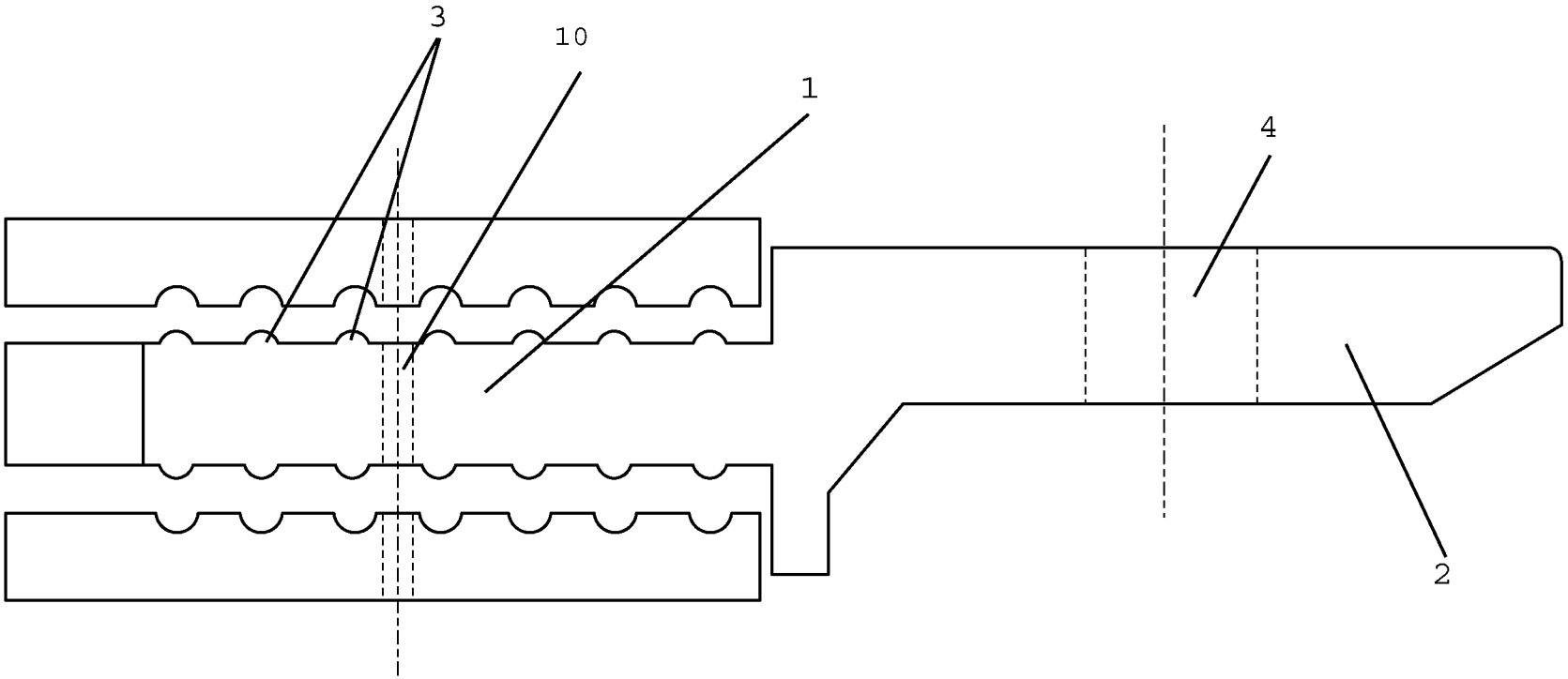
FIG. 1 depicts a cross sectional end view of one embodiment of the device of the present disclosure showing a cross sectional view of a first insertable tongue section (1) and corresponding cross sectional view of a second protruding mating section, configured as a top or male mating section (2). Please note that by simply inverting this figure, the top/male mating section would become a bottom/female mating section as they are mirror configurations of each other. Also depicted are the plurality of raised securing ridges (3) along a top and bottom surfaces of the first insertable tongue section and an example of a placement of one of the cut-outs (4) in the second protruding mating section. Please note that as will be described, an alternate embodiment includes cut-outs (10) in the first insertable tongue section as shown in this figure. This depiction also shows a potential pre-existing industrial matting, temporary roadway, support surface product in exploded view to illustrate how this embodiment of the device as disclosed would fit into a recess therein.

For clarity of disclosure, and not by way of limitation, the detailed description of the invention is divided into the following subsections that describe or illustrate certain features, embodiments or applications of the present invention.

Definitions

"pre-existing industrial matting, temporary roadway, support surface" as used herein means any existing sectional tiles of any suitable size and material used in the construction of temporary roadways, paths, machinery support surface or other support surfaces that can be applied over natural ground, sand, swamp, grass or other pre-existing surface which would not ordinarily be thought of as suitable to support a heavy load. Non-exhaustive examples of such mats are access mats, crane mats, swamp mats, equipment support mats, temporary road mats, and construction site and event site flooring.

"first insertable tongue section" as used herein means a component that can be inserted into a configured recess comprising notches, ridges or other protuberance that corresponds to a configured recess and slid to secure any component that is attached and inserted into it.

"second protruding mating section" as used herein means a component that is attached to a first insertable tongue section and configured into corresponding top or bottom pieces where a top piece is configured to mate securely with and correspond in a mirrored configuration with a bottom piece.

"raised securing ridges" as used herein means any ridge, notch or protuberance configured to work as a part of any tongue and groove construction that can slide down a properly configured recess, and includes but is not limited to, ridges, notches or protuberances that are rounded, squared off and/or comprise an L-shape or hook or other geometric interlocking puzzle configuration and are attached to a first insertable tongue section.

The System and Method of the Present Invention

The present disclosure teaches embodiments of an interlocking device capable of securing pre-existing industrial matting, temporary roadway, support surfaces to each other when configured as taught herein.

In one embodiment, there are basically two components to the device and two mirror configurations required. The first component is a first insertable tongue section that is the securing component securing the device to the pre-existing industrial matting, temporary roadway, support surface, and this component is identical in the two mirror configurations. The second component is the interlocking second protruding mating section. Here, this second component is required to be configured as either a top/male component or a mirror image bottom/female component. When properly configured, the end of a properly configured pre-existing industrial matting, temporary roadway, support surface with a top/male interlock device, will fit snugly against a corresponding end of a second properly configured pre-existing industrial matting, temporary roadway, support surface with a bottom/female interlock device. Once snugly fit together, pins can be inserted in aligned cut-out through holes to prevent any pulling apart. By continuing out in any direction, an entire surface area of any size or configuration can be achieved.

Figure 2:
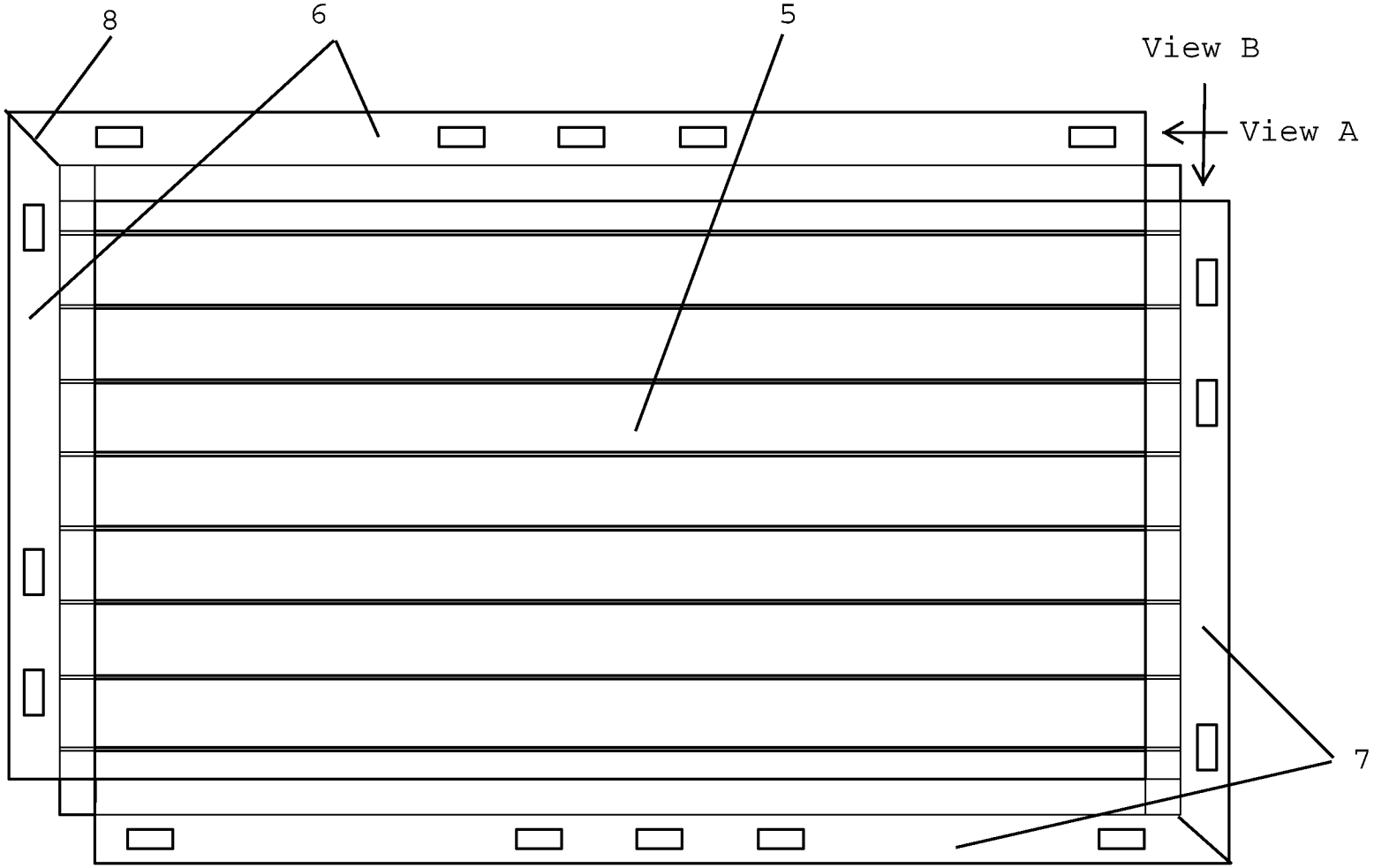
FIG. 2 depicts a top view of an industrial matting, temporary roadway, support surface product (5) configured with an embodiment of the device of the present disclosure as described herein and demonstrating which sections are top/male (6) and which are bottom/female (7) and with the corresponding ends of same as mitered in a forty-five degree angle (8).
Figure 3:
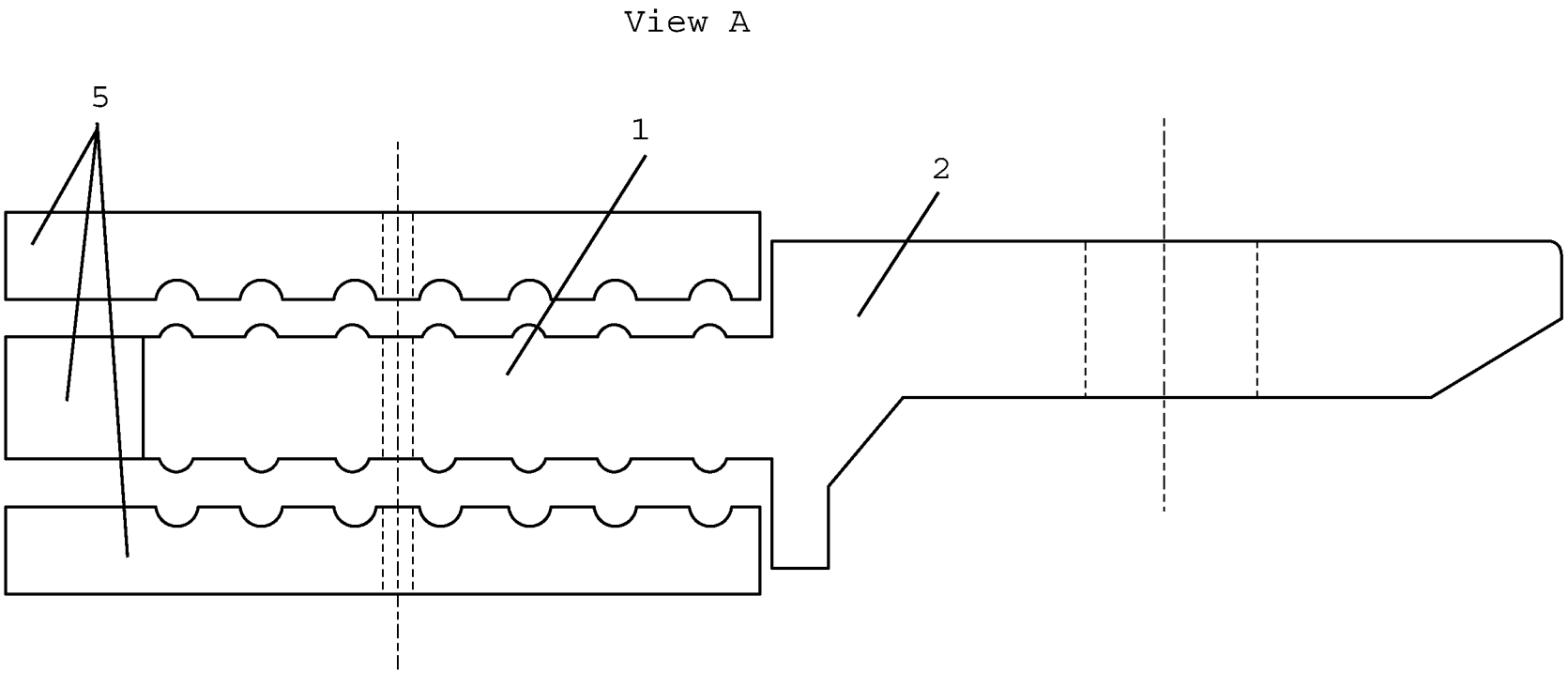
FIG. 3 depicts a cross sectional view of one embodiment of the device of the present disclosure of a top/male configured component (showing that this is View A as noted on FIG. 2) illustrating how the pre-existing industrial matting, temporary roadway, support surface (5—in exploded view) mat must be configured to allow the first insertable tongue section (1) of the device to slide into the configured recess securing the device in place with an attached top or male mating section (2).
Figure 4:
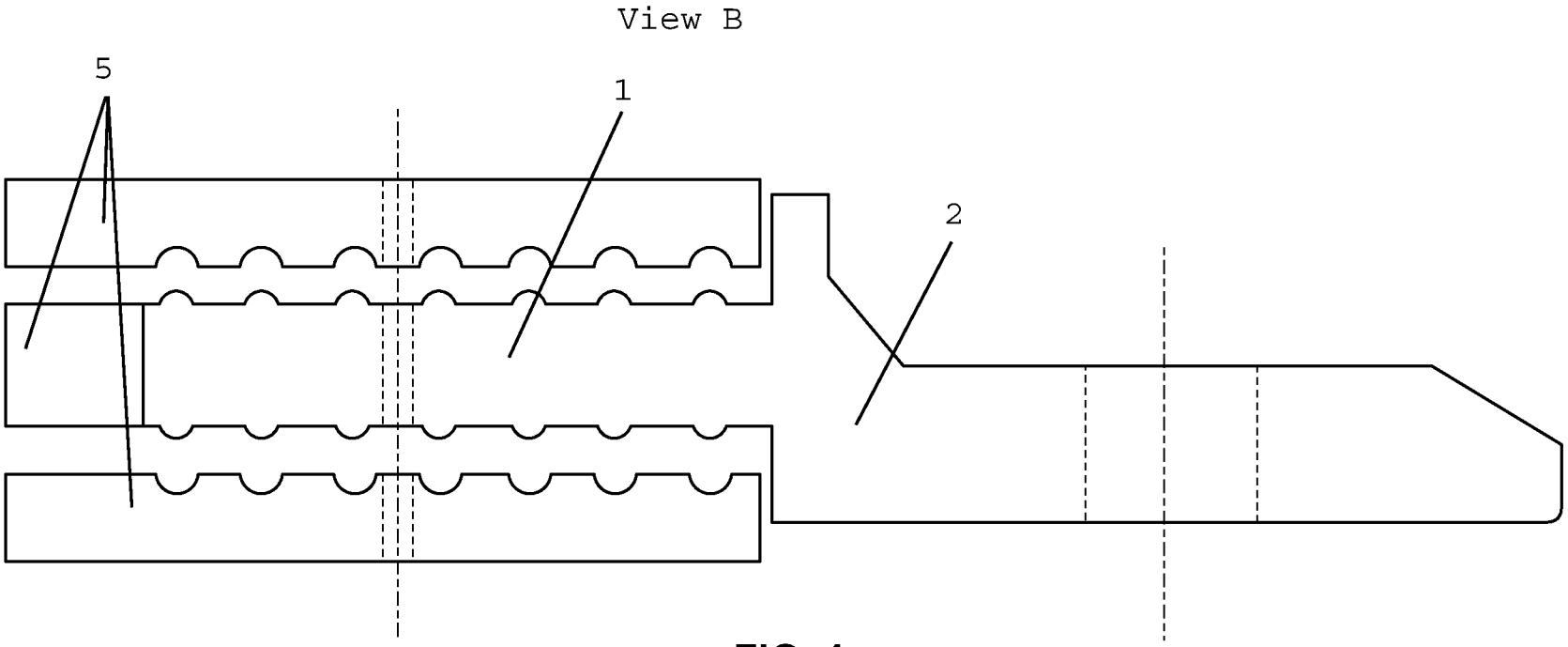
FIG. 4 depicts a cross sectional view of one embodiment of the device of the present disclosure of a bottom/female configured component (showing that this is View B as noted on FIG. 2) illustrating how the pre-existing industrial matting, temporary roadway, support surface (5—in exploded view) mat must be configured to allow the first insertable tongue section (1) of the device to slide into the configured recess securing the device in place with an attached bottom or female mating section (2). Note that whether the mating section component is a top or male mating section or a bottom or female mating section is solely a function of the orientation in which it is slid into the industrial matting, temporary roadway, support surface and not with any structural difference in the component itself and hence is indicated as the same component (2) on all of the drawings.
Figure 5:
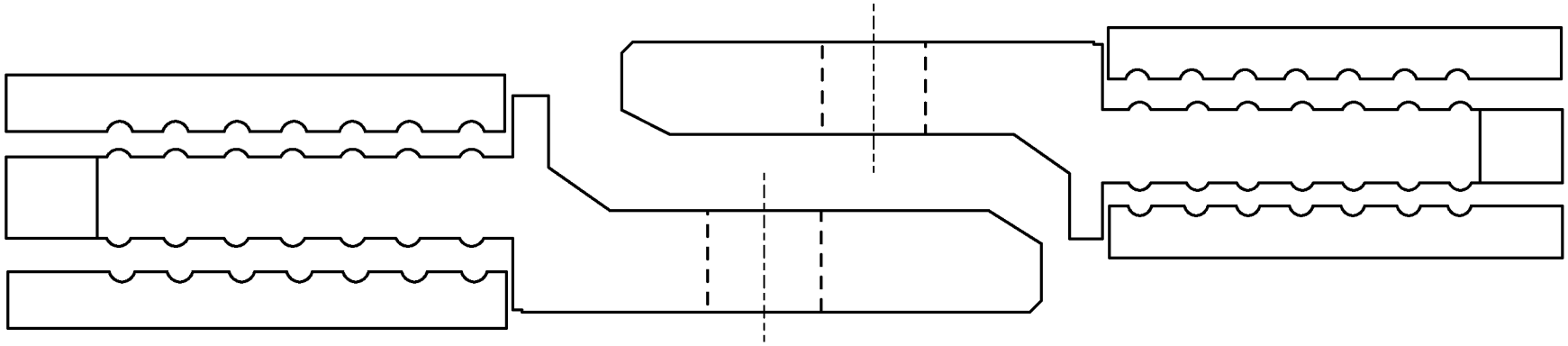
FIG. 5 depicts a cross sectional exploded view of one embodiment of the device of the present disclosure of how the top/male section overlays and fits snugly against the bottom/female section when properly configured allowing the cut-out holes to align such that pins (not shown) can be inserted securing the mats in place snugly against each other.

In one embodiment, referring to FIG. 2, if we say that the sides are North, East, South and West with the North and West sides as the 'top' or 'male' configured sides; and the South and East sides as the 'bottom' or 'female' configured sides; a first mat is laid down in any orientation. Then, a second mat is laid down with either its North side overlaying the first mat's South side; or, its West side overlaying the first mat's East side. The construction can continue in this manner in any direction an infinite amount of times. Each time a mat is laid down, wherever there is a top/male section overlaying a bottom/female section, pins are inserted in the aligned cut-out through holes to secure the mat in place relative to the prior mat to which it is attached.

In one embodiment, the device is configured according to FIG. 2 wherein the ends of the individual top/male and bottom/female sections are squared off. In this configuration, the first insertable tongue section ends at the end of the pre-existing industrial matting, temporary roadway, support surface and merely overhangs to mate with its corresponding section of another properly configured industrial matting, temporary roadway, support surface.

In an alternative embodiment, the ends of the individual top/male and bottom/female sections are mitered such that the adjacent top/male sections from a short and long edge of the pre-existing industrial matting, temporary roadway, support surface meet at a forty-five degree angle. In this embodiment, the through cut-out holes are configured in a different shape to attach the two adjacent mitered ends together as well as top section to bottom section.

In one embodiment, the device as taught herein may be constructed from and known suitable material. Examples include plastic, fiberglass, metals, metal alloys, composite materials, PVC, polyethylene, fiberglass reinforced plastics, and the like. One of skill in the art will be able to easily determine a desirable material based on the combination of strength, flexibility, durability, and price for a given application.

In one embodiment, the device as taught herein may be constructed as a solid one-piece unit. In an alternative embodiment, the first insertable tongue section may be constructed separately from second protruding mating section and then attached afterward.

In one embodiment, the device as taught herein is constructed in two lengths, namely, approximately seven to eight foot and thirteen to fourteen foot, but, any length may be chosen based on the sizing of the industrial matting, temporary roadway, support surface product with which the device is to be used. By inserting into a properly configured pre-existing industrial matting, temporary roadway, support surface in one direction, it can act as a top/male section. By flipping around and inserting in the opposite way, it can act as a bottom/female section. Only one configuration need be manufactured and only one recess preparation into the pre-existing industrial matting, temporary roadway, support surface need be performed—it is merely a matter of orientation in insertion and insuring that the correct length is inserted into the correct edge.

EXAMPLES

The present invention is further illustrated, but not limited by, the following examples.

Figure 6:
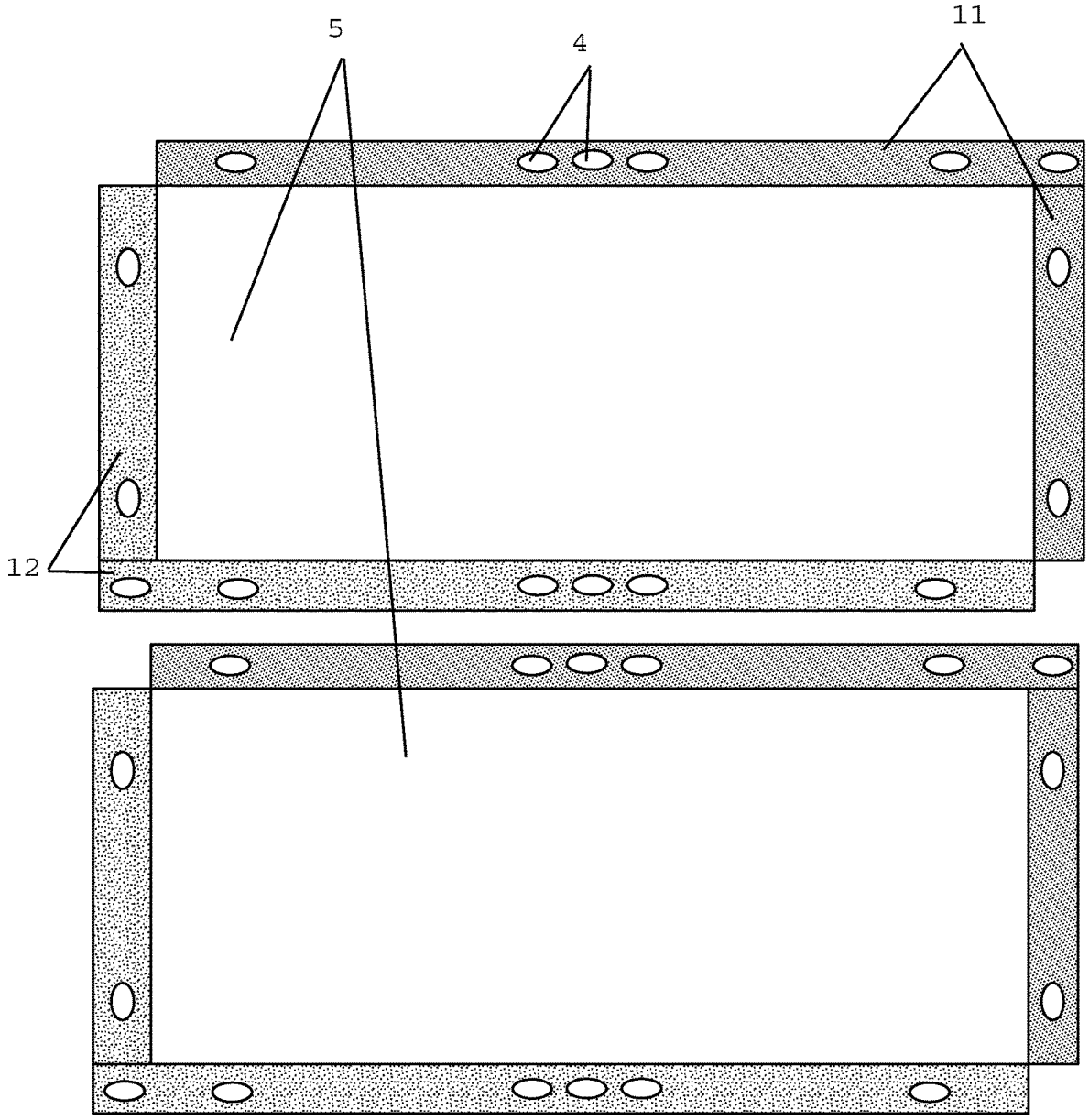
FIG. 6 depicts a top view of one embodiment of two configured mats using the device of the present disclosure as attached on all four sides of pre-existing industrial matting, temporary roadway, support surface product (5) with which it is to be used. The top/male (11) and bottom/female (12) configuration is illustrated. Note that the configuration may be reversed, but that if one piece is reversed, they should all be reversed. Also shown are one embodiment of cut-out (4) placements along the lengths of the device. Note that in this embodiment, the arrangement displayed is to demonstrate when the top/male second protruding mating section is placed over the bottom/female protruding mating section, the cutouts will align, and the ends are configured to create a continuous uninterrupted surface area as the mats are configured out in any direction. In this embodiment shown, the ends of each component are squared off as placed next to each other on each matting product. In this embodiment and configuration, on the long sides, the first insertable tongue section will end short of the end of the device to allow the short side to fit fully and snugly against the long side when both are inserted. Compare this configuration with the embodiment as shown in FIG. 2 where the ends are mitered at a forty-five degree angle. In actuality, the configuration of the first insertable tongue sections is the same in either configuration, with merely the configuration of the second protruding mating section either being mitered or squared off. The difference affects where cut-out holes can be placed as described elsewhere herein.

In one embodiment, referring to FIG. 6, existing industrial matting, temporary roadway, support surface products are configured to allow the device as described in this disclosure to be fitted on each side. Each side is then so fitted, two adjacent sides being fitted with a male/top configuration (adjacent sides will always include one short side and one long side) and the alternate sides being fitted with a female/bottom configuration. All matting tiles are to be fitted in the same configuration. Once so fitted, a male/top side is laid over a corresponding female/bottom side to fit the second protruding mating sections snugly together. In this embodiment, once so snugly fit, securing pins may be inserted into cutout holes that are aligned in this manner securing the sides together. Matting tiles are then continued to be laid together extending out in any desired direction creating a surface area of any size a multiple of the size the matting tiles in any direction. In this embodiment, simply removing the securing pins will allow the matting products to be disassembled by merely lifting them apart.

In one embodiment, the ends of the device of the present disclosure are squared off (as shown in FIG. 6). In this embodiment, this allows for a securing pin cutout to be placed on the end to align with a corresponding end of a corresponding male/female component and maintain structural integrity of having a side wall of the cutout without any break. In an alternative embodiment, the ends could be mitered (as shown in FIG. 2). In this embodiment, there will either be no cutouts at this location of the device, or the cutout configuration would be altered as a ninety-degree angled square corner thin cutout to maximize the strength of same wherein there will be a break in the sidewalls of the cutout.

In one embodiment, there could also be placed in the first insertable tongue section(s) a cutout (10) for use with securing pins in the same manner as shown with the second protruding mating sections. In this embodiment, similarly aligned cutouts would need to be made in the corresponding place in the industrial matting, temporary roadway, support surface product with which the device would be used to allow the through placement of securing pins as shown in FIG. 1.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A system comprising:

a pre-existing industrial matting temporary roadway, support surface, comprising at least one edge wherein said edge has been configured with a recess to accept insertion of a first insertable tongue section; and a unitary device comprising:

a first edge comprising a first insertable tongue section of a pre-determined width, length and thickness further comprising an at least one raised securing ridges along a top and bottom surface configured to be inserted into the said corresponding and pre-configured recess within said pre-existing industrial matting temporary roadway, support surface desired to be joined together; and an integral second protruding mating section on a second and opposite edge of said unitary device, configured as a top or bottom mating section, of a pre-determined width, length, thickness and cross-sectional geometric shape, wherein said cross-sectional geometric shape is configured to be a corresponding mating piece, top to bottom and bottom to top, connected to said first insertable tongue section and further comprising an at least one cut-out along its length placed to correspond with an at least one cut-out along the length of said corresponding mating pieces; and wherein said unitary device is attached to said pre-existing industrial matting temporary roadway, support surface.

2. The system of claim 1 wherein the overall length of the pre-existing industrial matting temporary roadway, support surface and the device is approximately seven to eight feet.

3. The system of claim 1 wherein the overall length of the pre-existing industrial matting temporary roadway, support surface and the device is approximately thirteen to fourteen feet.

4. The system of claim 1 wherein said unitary device is made from a material chosen from the following group: plastic, fiberglass, metals, metal alloys, composite materials, PVC, polyethylene, and fiberglass reinforced plastics.

5. The system of claim 1 wherein one end of the unitary device is squared off at a ninety-degree angle and the other end is mitered at a forty-five degree angle.

6. The system of claim 1 wherein both ends of the unitary device are squared off at a ninety-degree angle.

7. The system of claim 1 wherein the first insertable tongue section further comprises an at least one cut-out along its length.

8. The system of claim 1 wherein the height of the first insertable tongue section is approximately ⅓ of the thickness of the pre-existing industrial matting temporary roadway, support surface.

9. The system of claim 1 wherein the height of a pair of corresponding second protruding mating sections, when mated, are together substantially the thickness of the pre-existing industrial matting temporary roadway, support surface.

10. A method of using the system as claimed in claim 1 comprising the steps of, configuring said pre-existing industrial matting, temporary roadway, support surface with a recess on all sides capable of accepting an insertion of a properly configured first insertable tongue section; inserting a first insertable tongue section of a properly configured unitary device of claim 1 into the configured recess of one side of a configured pre-existing industrial matting, temporary roadway, support surface; repeating the foregoing until all sides of the industrial matting, temporary roadway, support surface contain an inserted device of claim 1; repeating the foregoing until a sufficient number of pre-existing industrial matting, temporary roadway, support surface products are so configured; laying a corresponding male/top second protruding mating section over its corresponding female/bottom second protruding mating section of adjacent industrial matting, temporary roadway, support surface products' sides; inserting securing pins in cut-out holes aligned in the corresponding male/top second protruding mating section—female/bottom second protruding mating section of adjacent industrial matting, temporary roadway, support surface products to secure them; repeating the foregoing as many times as desired to create a surface of a desired size.

* * * * *